US011701667B2

(12) United States Patent
Foeller

(10) Patent No.: US 11,701,667 B2
(45) Date of Patent: Jul. 18, 2023

(54) LOW PROFILE LOAD OUT LUMP BREAKER

(71) Applicant: Williams Patent Crusher and Pulverizer Company, Saint Louis, MO (US)

(72) Inventor: Christopher F. Foeller, Ballwin, MO (US)

(73) Assignee: Williams Patent Crusher and Pulverizer Co, St. Louis, MO (US)

( * ) Notice: Subject to any disclaimer, the term of this patent is extended or adjusted under 35 U.S.C. 154(b) by 41 days.

(21) Appl. No.: 16/445,462

(22) Filed: Jun. 19, 2019

(65) Prior Publication Data

US 2019/0381513 A1 Dec. 19, 2019

Related U.S. Application Data

(60) Provisional application No. 62/686,869, filed on Jun. 19, 2018.

(51) Int. Cl.

| | |
|---|---|
| ***B02C 23/10*** | (2006.01) |
| ***B02C 11/04*** | (2006.01) |
| ***B02C 23/08*** | (2006.01) |
| ***B02C 23/02*** | (2006.01) |

(52) U.S. Cl.
CPC ..... *B02C 23/10* (2013.01); *B02C 11/04* (2013.01)

(58) Field of Classification Search
CPC ..... B02C 23/10; B02C 23/02; B02C 23/08; B02C 23/20; B02C 23/23; B02C 11/04
USPC ..... 241/281
See application file for complete search history.

(56) References Cited

U.S. PATENT DOCUMENTS

| | | | | |
|---|---|---|---|---|
| 1,400,234 | A * | 12/1921 | Owens | B02C 11/04 209/137 |
| 4,580,698 | A * | 4/1986 | Ladt | B65G 47/19 177/122 |
| 5,071,075 | A * | 12/1991 | Wiens | B03B 9/06 241/19 |
| 5,074,435 | A * | 12/1991 | Suverkrop | B02C 23/02 222/55 |
| 2009/0101740 | A1* | 4/2009 | Liu | B03B 9/04 241/25 |
| 2011/0174907 | A1* | 7/2011 | Davis | B02C 23/02 241/101.74 |

OTHER PUBLICATIONS

Baghouse prior date Aug. 14, 2015 , retrieved date Oct. 25, 2021. https://www.baghouse.com/wet-scrubber-diagram/.*

* cited by examiner

*Primary Examiner* — Shelley M Self
*Assistant Examiner* — Mohammed S. Alawadi
(74) *Attorney, Agent, or Firm* — Sandberg Phoenix & von Gontard, PC

(57) ABSTRACT

A load out lump breaker system includes a load out chute operably associated with a material storage bin, a screen hopper for screening lumps of material from downloaded materials, a mill for breaking up lumps of material, a mill diversion chute operably associated with the screen hopper, a discharge chute for transport of material from the mill, a plurality of gates and sensors for coordinating the switching of operations between load out and lump break up, and a controller programmed to switch and synchronize operations between load out and lump break up operations.

17 Claims, 1 Drawing Sheet

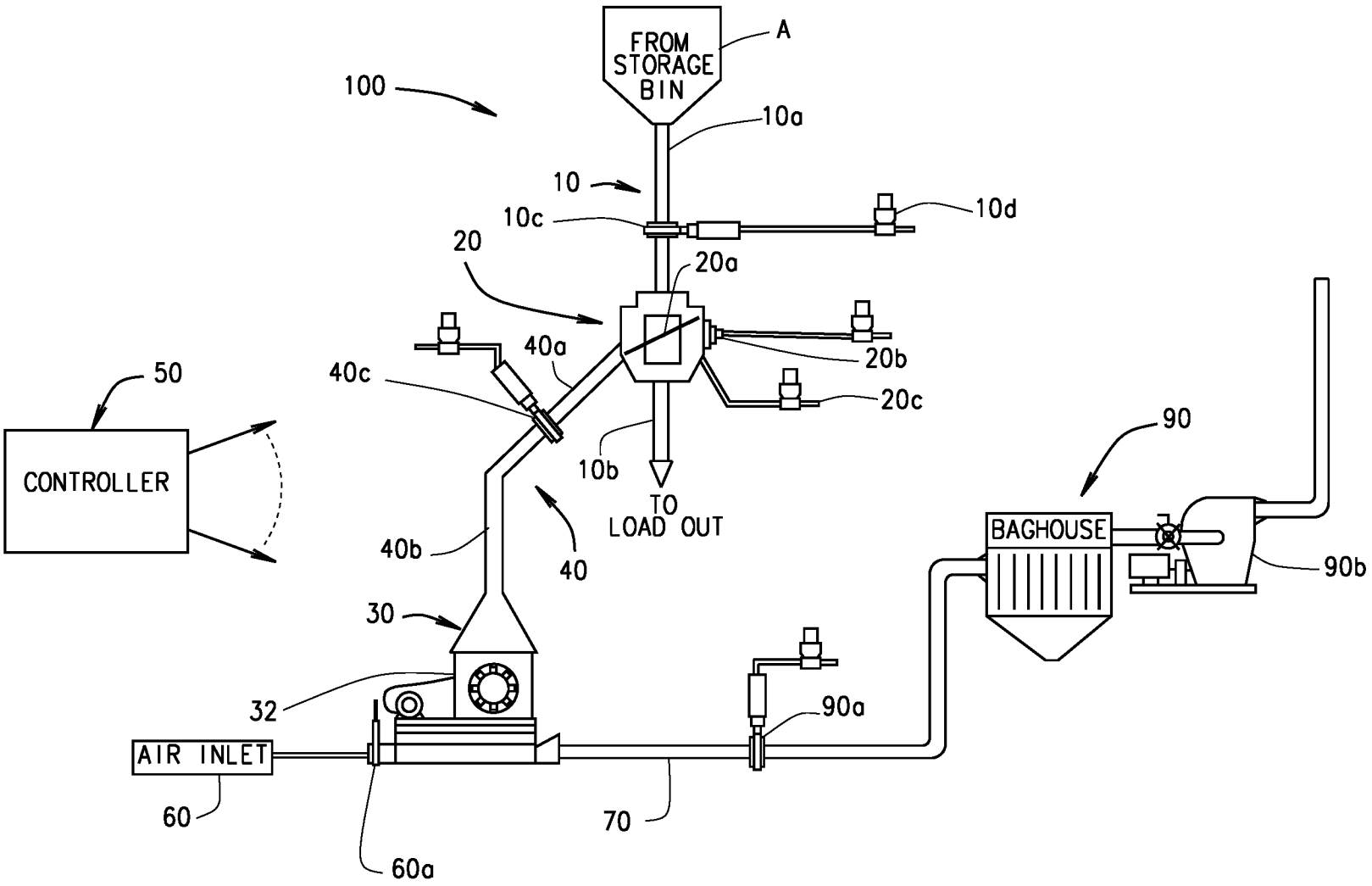
FROM STORAGE BIN
A
10a
10
10c
10d
20
20a
20b
20c
TO LOAD OUT
10b
40a
40c
40
40b
30
32
100
50
CONTROLLER
AIR INLET
60
60a
70
90a
BAGHOUSE
90
90b

LOW PROFILE LOAD OUT LUMP BREAKER

CROSS-REFERENCE TO RELATED APPLICATIONS

This application claims priority to U.S. Provisional Application Ser. No. 62/686,869, filed on Jun. 19, 2018, which is incorporated herein by reference in its entirety.

STATEMENT REGARDING FEDERALLY SPONSORED RESEARCH

Not Applicable.

BACKGROUND OF THE DISCLOSURE

The present disclosure relates to a load out lump breaker system and methods related thereto for a dry powder load out facility and, in particular, the present disclosure relates to such a system which can be advantageously installed to retrofit an existing load out facility which does not have, and cannot readily accommodate, a large, standard crusher, e.g., because of space limitations.

"Load out" facilities are associated with all types of materials. These include, for example, clay, diatomaceous earth, cement, limestone, gypsum, coal and petroleum coke. They conceivably can include a very wide variety of bulk powders, but especially bulk powders having hydroscopic characteristics.

In a typical load out facility, the material is loaded onto trucks or rail cars, and if agglomerated material, or a "lump", plugs up the pneumatic or other discharge line used by the truck, the truck will need to be returned to the load out facility to dump its load and have it replaced with a (hopefully) lump-free fresh load.

In some such facilities, removal of lumps is facilitated by placement of a screen in the pathway of material flow to prevent any agglomerated material over a certain size to which the screen is calibrated to snare, to enter the bed of a truck being loaded. In such systems, whenever plugging was recognized to occur, an operator would manually remove the lumps via an access door placed above it. This can be cumbersome, time consuming and involve some risk to such operators making the manual removal.

While large lump crushers capable of handling the full load out material flow needs of a larger payload facility are pre-designed (and given the space) to be part of some facilities, once a load out facility is built, the space to install a working lump crusher capable of handling full loadout material flow may generally no longer exist. It was, however, generally thought impossible to fit a mechanical lump breaking system within the smaller spaces available, and use of larger lump crushers can be highly inefficient, as less than 1% of the material is likely to be agglomerated into large enough lumps such that they might cause issues downstream.

Accordingly, there is a need for operations personnel to save time and reduce their risk of injury from regularly manually clearing lumps from lump retention screens. Further, it would be highly desirable if the need for product trucks to be returned to points of origin to dump their loads due to lumps and to reload could be greatly reduced. Moreover, there is a great need for efficient lump removal systems either for installation into load out facilities previously without them or of a size which prevents or inhibits efficient use of a large crusher.

SUMMARY OF THE INVENTION

Accordingly, applicant has developed a system, method and apparatus providing the ability to automate low profile load out lump breaking which addresses the common problems and deficiencies of current systems outlined above and which provides additional advantages. The present invention addresses the special problem faced by load out facilities lacking a built in large-scale full loadout material flow lump crusher and either lacking the space to install such a crusher, or for which such a large-scale crusher system would be highly inefficient for its needs. The system and method provided greatly enhances safety and saves considerable time as the system can be fully automated and programmed to work at the push of a button. As detailed below, in embodiments, it includes sensors, programming software, interlocks and timers to ensure that the system's components work in tandem. With a streamlined low profile isolation and screening system component to feed the crusher, the lump breaking system of the invention can readily fit into an existing facility not having a crusher, having only limited space, or which makes an economically favorable option for a new facility of more limited capacity. Moreover, depending at what point existing previously undetected lumps are now crushed, the need for trucks with lump issues to return to the point of origin is greatly minimized and/or the larger volume of material reclaimed from broken up lumps can be reclaimed as sellable products. Finally, housekeeping can be greatly improved as the prior system of manually clearing lumps created a great deal of mess not present in the automated system embodiments of the present invention. As another feature, in preferred embodiments, the system is fully enclosed and self-contained, and thus, rarely needs to be opened during normal operations.

Accordingly, in one aspect, applicant has developed a load out lump breaker system. The system comprises a load out chute operably associated with a material storage bin and is configured to download material from the bin. The system also includes a screen hopper for screening lumps of materials from downloaded materials during the load out process. The load out chute includes an upper portion positioned above the screen hopper and a lower portion positioned below the screen hopper. The system also includes a mill for breaking up lumps of material and a mill diversion chute operably associated with the screen hopper through which lumps of material may be diverted for break up by the mill, or crusher. Associated with the mill is a discharge chute which transports the material away from the mill once lumps have been removed. Additionally, the breaker system includes a plurality of gates and sensors for coordinating the switch of operations between load out and lump break up operations and a controller programmed to switch and synchronize operations of the systems components.

In another aspect, a method for breaking up lumps of material formed in materials being downloaded at a load out facility using a low profile load out lump breaker system is provided. The method includes the steps of obtaining a low profile lump breaker as described above and herein and incorporating the lump breaker into the material load discharge pathway, or using such a system which has been previously installed. When a load of material is ready for discharge from a load out facility's storage bin operably associated with the low profile load out lump breaker system, the process further includes opening, or confirming that the loadout isolation gate is opened, closing, or confirming that the mill isolation gate is closed, discharging the load of material downstream through the upper portion of the load out chute, through the screen hopper and a screen contained therein to screen out lumps of material above a certain threshold size, on to the lower portion of the load out chute and then loaded out via truck bed or other unit. The controller is activated to sense when a certain value of lumps (e.g., by weight, or delayed discharge) of material has been reached above the screen in the screen hopper, and upon reaching that value, to signal the lump crushing process to commence. The lump crushing steps include, closing the load out isolation gate to hold back additional material from the lump crushing mill, starting operation of the lump crushing mill to begin crushing lumps upon delivery, vibrating the screen vibrator to assist in feeding lumps accumulated at the screen hopper to the lump crushing mill, opening the gate for, or confirming the crushed lumps discharge chute is open, opening the mill isolation gate, crushing lumps of material, and transporting the crushed lumps of material to the discharge chute.

The present disclosure also includes a method for retrofitting a load out facility with a low profile load out lump breaker system and an apparatus for carrying out the retrofitting.

BRIEF DESCRIPTION OF THE DRAWING

The presently disclosed subject matter will be better understood from reading the following description of non-limiting embodiments, with reference to the attached drawing, wherein below:

The attached drawing illustrates a schematic depiction of an embodiment of a lump crusher system according to the invention.

DESCRIPTION OF THE PREFERRED EMBODIMENT

The foregoing summary, as well as the following description illustrates the disclosure by way of example and not by way of limitation. The description enables one skilled in the art to make and use the invention, describes several embodiments, adaptations, variations, alternatives, and uses of the disclosure, including what is presently believed to be a preferred mode of carrying out the disclosure.

Referring to the drawing, a low profile lump crusher system 100 includes a load out chute 10 to receive a load of materials from a load out facilities storage bin A. The chute 10 has upper 10*a* and lower 10*b* portions roughly divided by a screen hopper 20. The screen hopper 20 includes a screen 20*a* through which the load material must pass and which serves to limit lumps larger than a certain dimension or mesh size from passing. When the screen 20*a* becomes plugged, the load out isolation gate 10*c* closes to stop material flow from the storage bin A and the mill isolation gate 40*c* is opened to crush the trapped lumps. The screen hopper 20 also includes a screen vibrator 20*b* which serves to assist feeding lumps to the mill 30, such as a hammer mill. The mill 30 is operably associated with a mill motor 32 which assists in actuating the mill 30 to chew up material lumps. In certain embodiments, the screen hopper 20 further includes a screen fluidizing air header 20*c* which injects fluidized air into the region above and the screen to aid in keeping material flowing through the screen. A secondary diversionary chute 40 is connected to the screen hopper 20 on one end and the mill 30 at the other and is roughly divided into upper 40*a* and lower 40*b* portions. In a preferred embodiment, a controller 50, such as a computer software system housed in a control room, or otherwise connected to the system, preferably by wired connections, is programmed to ensure that the system remains fully automated, as detailed below, and opens and closes gates to efficiently divert lumps to the crushing mill when appropriate and returns the system to normal load out operation afterwards.

The lump crusher system 100 also includes a number of gates for safely and efficiently controlling material flow and switching between normal and crushing operations. These include a load out isolation gate 10*c* positioned between the storage bin A and the screen hopper 20 to allow or prevent material flow before the screen hopper 20, a mill isolation gate 40*c* located between the screen hopper 20 and the mill 30 to allow or prevent the flow of lump containing material between these as needed. In preferred embodiments, also included are an air inlet 60 and an air inlet gate 60*a* which controls air flow used to move crushed material from the mill 30 through a third, discharge, chute 70, and past another, e.g., bag isolation gate 90*a* which controls flow through the discharge chute 70 to the baghouse 90 for recycling. In preferred embodiments, the load isolation gate 10*c* is fitted with an oversized actuator 10*d*, sized to aid in operating in a chute 10 plugged with material. "Oversized" in this context is used in reference to the isolation gate used. Those skilled in the art look at it as a "Heavy Duty" type application. For example, if x force must be generated by an actuator to drive a gate closed without material in the way, 2-4× is required to ensure there is enough power to push the gate closed with material in the way. With variability of air pressure supply and load out chute dimensions dictating the baseline force required to close a gate at customer locations, this will require quantification as a force rather than simply a pre-set dimension.

During normal operation, the loadout isolation gate 10*c* is open and the mill isolation gate 40*c* is closed. Material flows through the screen hopper 20 to the lower chute portion 10*b*. When enough lumps are collected on the screen 20*a* such that, e.g., loading slows down to a certain level, the controller 50 activates a sequence to proceed with lump crushing so that the load out facility can be returned to normal operation. In this sequence, the loadout isolation gate 10*c* is signaled to close to hold back any additional material from being transported to the crusher. Concurrently, the mill motor 32 actuates the mill to start. The screen vibrator 20*b* starts to assist lumps in being fed to the mill/crusher 30. The baghouse isolation gate 90*a* opens and the mill isolation gate 40*c* also opens. The lumps are crushed and air from the air inlet 60 is drafted through the air inlet gate 60*a* and conveys the crushed material from the mill through to the baghouse collector 90. The bag house fan 90*b* also runs and is monitored to ensure that material moves forward. Once the lumps are crushed, normal operation and loading of material can continue.

To retrofit a load out facility built without an installed lump crusher a retrofitting apparatus which includes a load out isolation gate, a screen hopper, and means to attach the retrofitting apparatus to the load out facility's existing load out chute are used to make the lump crusher addition. These are "low profile" retrofits because the apparatus is required to be fitted into the existing load chutes, and these can be narrow or pose other difficulties. Preferably, a "bolted in" attachment system (e.g., bolts secured with nuts and the like) is used for attachment to minimize modification to the chute work. However, attachment by welding or by modification of the chute work is contemplated as being within the scope of certain embodiments of the invention. In operation, a load out chute is retrofitted by inserting the retrofitting apparatus described above and securing them with bolts or other approaches to the chute as indicated. This provides the basis to enable the lump crusher's addition.

Thus, in operation, the low profile lump crusher system according to an embodiment of the invention includes isolation gates and related mechanisms to transition the load out system from normal load out operations to one instead used for diverting a volume of material containing agglomerated material sensed in some manner, e.g., by causing the speed of load out operations to slow to under a minimum value, to a low profile mill. Upon such a switch, the lumped material is crushed and then the system is switched back again to normal load out operations after such material has been fed back into the material stream (or otherwise disposed). The low profile lump crusher used can be of varying sizes depending on the available space of the load out facility, the likely volume of agglomerated material anticipated to be diverted during load out operations and other factors known to those skilled in this art. The lump crusher installed is preferably from about 10" to about 26", and more preferably from about 15" to about 24". Such sized crushers can handle a lump target size and volume for the purposes ideally served by a low profile lump crushers of the invention.

In a preferred embodiment, the system is fully automated and self-contained to operate in most circumstances at the push of a button. A controller (control system) 50 is programmed to detect sensors which have been wired or which operate remotely, and pre-tested so that each system component's status (e.g., whether gates are open or closed, the mill is running or not, the bag house fan is operating at a sufficient level, etc., is determined) and can also be programmed to operate with timers, alarms, and system interlocks so that the sequencing of all components work in synchronized tandem, safely and efficiently. The programming of the system, e.g., prevents the mill isolation gate from being opened unless and until various sensors show that the load out isolation gate is closed, the bag house fan is blowing sufficiently, the bag house isolation and air inlet gates are opened, and the mill motor is powering the mill.

Alternatives can be provided to various components of the low profile lump breaker as described above regarding certain embodiments and others will be introduced as new embodiments are introduced. In one such embodiment, e.g., a gravity discharge system in which the lump material is moved back into the normal load out process substitutes for the bag house collector system which was described.

Alternative actuating systems may also be employed. For example, although in a preferred embodiment, pneumatic valve actuators and vibrators are used, an electrical system, or one or more electrical components may be substituted.

While the preferred embodiment is a fully automated system, the various individual operating elements of the low profile lump breaker and system, such as the mill, gates, screens and so forth, may also be manually controlled (or have manual backups) as well as controlled by an appropriately programmed computer control system. The control system may include a closed loop feedback feature that automatically adjusts operations of any element in response to the operation or performance of another element for peak efficiency.

a. In view of the above, it will be seen that the several objects of the invention are achieved and other advantageous results are obtained. As various changes could be made in the above constructions without departing from the scope of the disclosure, it is intended that all matter contained in the above description or shown in the accompanying drawings shall be interpreted as illustrative and not in a limiting sense.

What is claimed is:

1. A system for crushing of dry powder containing lumps during dry powder load out, the system comprising:

a load out chute operably associated with a material storage bin configured to download dry powder material from the bin, a screen hopper configured for screening lumps of dry powder material above a threshold size from downloaded dry powder materials during the load out process, the load out chute comprising an upper portion positioned above the screen hopper and a lower portion positioned below the screen hopper and further positioned to transfer the downloaded dry powder material to a waiting receptacle during load out;

a mill configured for breaking up the lumps of dry powder material above the threshold size aggregated from the dry powder material accumulated above the screen hopper;

a mill diversion chute operably associated with the screen hopper through which the lumps of dry powder material above the threshold size aggregated from the dry powder material accumulated above the screen hopper may be diverted for break up by the mill;

a discharge chute for transport of dry powder material to be discharged once the lumps of dry powder material above the threshold size aggregated from the dry powder material have been broken up by the mill;

a load out isolation gate configured to open and close, operably associated with the load out chute and configured to close upon command to stop dry powder material flow from the load out chute when signaled that the screen hopper has become or is becoming plugged with lumps; and a mill isolation gate configured to open and close and configured to open upon command to feed the lumps of dry powder material to the mill for breaking up the lumps of dry powder material in a synchronized manner with the load out isolation gate, the load out isolation gate closing in association with the mill isolation gate opening; and, a controller programmed to synchronize operations between load out and lump break up operations, including operably synchronized opening and closing of the load out isolation gate with the mill isolation gate upon automated signaling that the screen hopper has become or is becoming plugged with the lumps of dry powder material above the threshold size aggregated from the dry powder material and prevents the mill isolation gate from being opened for crushing of dry powder containing said lumps by the mill unless the load out gate is closed.

2. The system of claim 1, wherein the loadout isolation gate is located in upper portion of the load out chute.

3. The system of claim 2, wherein the loadout isolation gate further comprises an oversized actuator in comparison to one sufficient for operation when unplugged with material in order to facilitate operations of the load out chute when in a state wherein the chute is plugged with material.

4. The system of claim 1, wherein the mill isolation gate is operably associated with the mill diversion chute.

5. The system of claim 4, wherein the mill isolation gate further comprises an oversized actuator to operate the mill diversion chute in comparison to one sufficient for operation when unplugged with material in order to facilitate operations of the chute when in a state wherein the chute is plugged with material.

6. The system of claim 1, wherein the mill is operably linked to a baghouse through a discharge chute.

7. The system of claim 6, wherein the broken up lumps of material are moved from the mill to the baghouse by a combination of a baghouse fan and an air inlet operatively associate with the discharge chute.

8. The system of claim 7, wherein the system further comprises a bag isolation gate to regulate movement of the broken up lumps of material from the mill discharge chute to the baghouse.

9. The system of claim 7, wherein the system further comprises an air inlet gate.

10. The system of claim 1, wherein the screen hopper is operably associated with a screen vibrator.

11. The system of claim 1, wherein the controller programmed to synchronize between the load out and the lump break up operations receives signals from sensors to coordinate switching operations by opening and closing the gates to switch and synchronize system components between load out and lump break up.

12. The system of claim 11, wherein the sensor sends a signal to the controller based on accumulated weight of material upon the screen hopper.

13. The system of claim 11, wherein the sensor sends a signal to the controller based on load out of material being slowed to below a certain threshold rate.

14. The system of claim 1, wherein a screen fluidizing air header is associated with the screen hopper.

15. The system of claim 1, wherein the system further comprises a mill motor to actuate the mill to start crushing operations.

16. The system of claim 1, wherein the system further comprising one or more of a timer system, an alarm, and an interlock system to facilitate system synchronization of operation between the load out and lump crushing operations.

17. The system of claim 1, wherein the dry powder containing lumps is selected from the group consisting of clay, diatomaceous earth, cement, limestone, gypsum, coal and petroleum coke.

* * * * *